United States Patent [19]

Tsai

[11] Patent Number: 4,983,483

[45] Date of Patent: Jan. 8, 1991

[54] ORGANIC PHOTORECEPTOR FOR USE IN ELECTROPHOTOGRAPHY EMPLOYING SQUARYLIUM AND COPPER PHTHALOCYANINE AS CHARGE GENERATION MATERIALS

[75] Inventor: Lii C. Tsai, Hsinchu, Taiwan

[73] Assignee: Industrial Technology Research Institute, Taiwan, China

[21] Appl. No.: 339,178

[22] Filed: Apr. 14, 1989

[51] Int. Cl.[5] ..... G03G 5/06

[52] U.S. Cl. ..... 430/59; 430/73; 430/74

[58] Field of Search ..... 430/59, 58, 73, 74; 564/307

[56] References Cited

U.S. PATENT DOCUMENTS

| | | | |
|---|---|---|---|
| 3,672,979 | 6/1972 | Gerace et al. | 117/201 |
| 3,816,118 | 6/1974 | Byrne | 101/462 |
| 4,123,270 | 10/1978 | Heil et al. | 8/41 |
| 4,507,374 | 3/1985 | Kakuta et al. | 430/56 |
| 4,536,461 | 8/1985 | Nakatani et al. | 430/58 |
| 4,618,879 | 10/1986 | Katuta et al. | 430/58 |
| 4,621,038 | 11/1986 | Kazmaier et al. | 430/73 |
| 4,755,443 | 7/1988 | Suzuki et al. | 430/58 |

*Primary Examiner*—John Goodrow

*Attorney, Agent, or Firm*—Scully, Scott, Murphy & Presser

[57] ABSTRACT

A photoreceptor comprising a conductive support, a charge generation layer coated on the conductive support and a charge transport layer coated on the charge generation layer wherein the charge generation layer comprises a polymer binder and an induced alpha-type charge generation material prepared by milling a mixture of a copper phthalocyanine pigment and a squarylium pigment.

9 Claims, 2 Drawing Sheets

ORGANIC PHOTORECEPTOR FOR USE IN ELECTROPHOTOGRAPHY EMPLOYING SQUARYLIUM AND COPPER PHTHALOCYANINE AS CHARGE GENERATION MATERIALS

BACKGROUND OF THE INVENTION

Since the invention of Xerography (which means "dry writing" in Greek) by C. Carlson in 1938, new facilities utilizing this technique such as Xerox copier, laser printer and optical printer have provided inexpensive, convenient and fast services of copying documents and played important roles in office automation.

The focus of the Xerography technique resides in the photoreceptor which is an optical element electrically insulative before exposure under light and becomes electrically conductive after exposure. The Xerographic process comprises mainly five steps, namely, (1) charging, (2) photodischarging, (3) image transfer, (4) development and (5) cleaning. In order to obtain printed images of high quality, the photoreceptor must have high charge acceptance, low dark conductivity and fast photoconductivity (i.e., high sensitivity).

Photoreceptors can be classified as inorganic or organic. Due to the advantages of low production cost, non-toxicity and high flexibility, organic photoreceptors (OPC) have replaced inorganic photoreceptors and come into prominence in commercialized photoreceptors.

The structure of photoreceptors may be classified as (1) mono layer type, (2) functionally separated laminated type, and (3) microcrystalline distribution type. The functionally separated laminated layer type is the most preferred because it contains separated charge generation layer (CGL) and charge transport layer (CTL) and thus is highly flexible in the selection of materials for each layer. The characteristics and requirements may be adjusted as desired independently in CGL or CTL. This type of photoreceptors are predominant among the present photoreceptors.

The functionally separated laminated type photoreceptors are generally composed of a conductive support, a charge generation layer and a charge transport layer. An optional barrier layer may be inserted between the conductive support and the charge generation layer. In the production of photoreceptors of this type, a charge generation layer composed of a charge generation material and a polymer binder is coated on a conductive support and then a charge transport layer composed of a charge transport material and another polymer binder is coated.

Among the light sources for laser printers, the helium or neon laser has the wavelength of 633 nm, and the wavelengths of semiconductor lasers (such as arsenic aluminium gallium laser) is 780 nm or longer. Light sources having such wavelength are generally classified as "near infrared" light. Because semiconductor lasers can be installed in a minimum construction, are highly reliable, and can operate at high speed, they are most commonly used. In conformity with the semiconductor lasers, the charge generation material used in the OPC for semiconductor laser printers must possess high sensitivity to lights of 780 nm or higher wavelength.

U.S. Pat. No. 4,426,434 discloses a process for producing OPC in which a conductive support is vacuum deposited by chloroaluminium phthalocyanine or chloroaluminium monochlorophthalocyanine and treated with solvent vapor to produce an OPC having improved sensitivity to light within the range of near infrared wavelengths. However, the process involves a step of vacuum-deposition which requires expensive apparatus and needs very a long processing time. The cost for the process is therefore very high, rendering the implementation of the process nearly impractical.

U.S. Pat. No. 3,824,099 discloses that squarylium pigment is sensitive to wavelengths of near infrared range. The squarylium pigment is generally prepared by an "acid route" in which one equivalent of squaric acid and two equivalents of N,N-dialkylanilines derivatives is reacted in an azeotropic solvent. The synthesis reaction is quite simple and has high yield. However, the squarylium synthesized by this process has high dark conductivity and low charge acceptance when used as the charge generation material for photoreceptor. To minimize the influences of these two drawbacks, the thickness of the charge generation material layer must become very thin. Under such thickness, the ability of the photoreceptor to absorb incident lights will be lowered and a large amount of incident light will be reflected, resulting in severe interference and great degradation in the quality and resolution of the printed image or characters.

Copper phthalocyanines pigments have high coloration value, photo-resistance, heat resistance and chemical-resistance and are non-toxic and thus are commonly used as green-blue pigment. The pigments are known to exist in eight crystalline forms, i.e., alpha-, beta-, epsilon-, gamma-, delta-pi-, rho- and chi-types, with alpha-, beta- and epsilon- being the most prevailing. Copper phthalocyanines pigments have long been studied for use as a photosensitive material but due to their low sensitivity they have never been developed to a stage of industrial implementation.

SUMMARY OF THE INVENTION

Accordingly, it is thus an object of the present invention to provide a charge generation material of high sensitivity, low dark conductivity and high charge acceptance.

It is a further object of the present invention to provide a charge generation material of high sensitivity, low dark conductivity and high charge acceptance for use in a laminated type photoreceptor for electrophotographic purpose.

It is another object of the present invention to provide a laminated photoreceptor comprising a charge generation .layer made of the charge generation material of the present invention.

The subject invention in its broadest context encompasses a laminated type photoreceptor comprising a conductive support, a charge generation layer coated on the conductive support and a charge transport layer coated on the charge generation layer, wherein the charge generation layer comprises a polymer binder and an induced alpha-type charge generation material prepared by milling a mixture of a copper phthalocyanine pigment and a squarylium pigment in a specific relative ratio.

Figure 1:
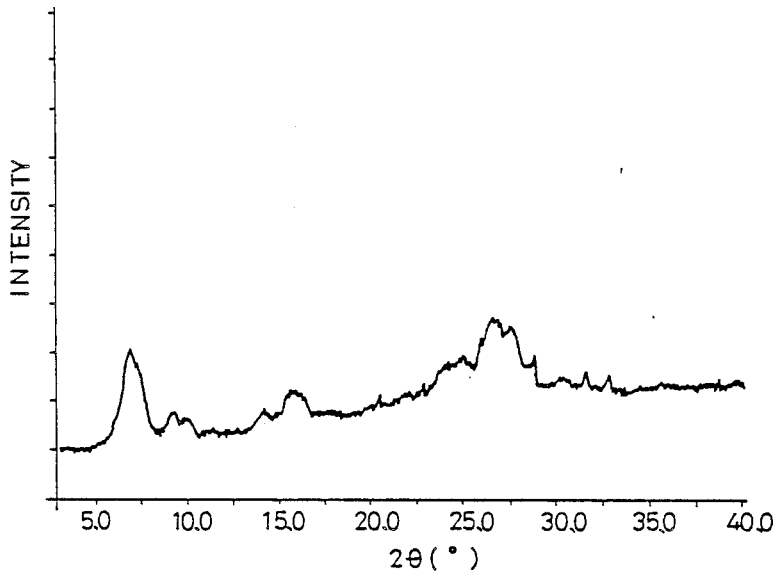
FIG. 1 is the X-diffraction diagram of the "induced alpha-type" charge generation material of the present invention.

It was unexpectedly found that low dark conductance, high charge acceptance and high sensitivity to near infrared light can be realized on a photoreceptor by a charge generation material of induced alpha-form crystalline structure prepared by milling a mixture of a copper phthalocyanine pigment and a squarylium pigment in a specific relative ratio to convert the crystalline structure to induced alpha-type.

The individual elements of the present invention are described in detail below.

The term "copper phthalocyanine" generally refers to a bright blue pigment of the formula $C_{32}H_{16}N_8Cu$ which could be produced by heating phthalonitrile with cuprous chloride. The pigment is frequently referred to as "Pigment Blue 15." The copper phthalocyanine pigment for use in the present invention could be directly purchased from the market without necessity to be further purified and thus the cost of its utilization can be greatly reduced. There are at least eight different crystalline structures for the copper phthalocyanine pigments as stated above and the preferred crystalline structures for the present invention are those of alpha-type and epsilon-type. Examples for the copper phthalocyanines are Heleigen Blue L6700 available from BASF Co. and Lionon Blue ES available from Toyo Ink Co.

Squarylium pigment is generally prepared by an acid route such as that described in U.S. patent application Nos. 3,617,270, 3,824,099, 4,175,956, 4,486,520 and 4,508,803 which can be carried out with simple procedures and apparatus, has short reaction time and is high in yield. The squarylium pigment is therefore very inexpensive and is easily available.

The preferred squarylium pigments contemplated by the present invention may be represented by the structural formula (I)

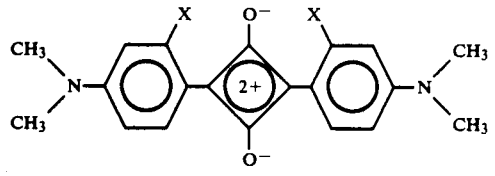

(I)

wherein X represents hydroxy, hydrogen or $C_{1-5}$ alkyl, preferably hydroxy, hydrogen or methyl.

The squarylium of formula (I) may be prepared by reacting an equivalent of squaric acid of formula (II)

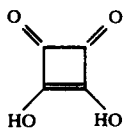

(II)

and two equivalents of N,N-dimethylaniline derivatives of formula (III)

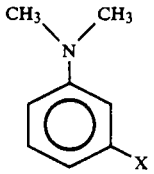

(III)

in an azeotropic solvent. Examples for the azeotropic solvents are toluene and n-butanol.

The copper phthalocyanine pigment and the squarylium pigment are mixed in a weight ratio between 100:3 and 100:30, preferably between 100:5 and 100:20, and then milled to convert the mixture into an "induced alpha-type" charge generation material to give the charge generation material of the present invention. The "Induced alpha-type" charge generation material exhibits an X-ray diffraction pattern which has strong diffraction lines as Bragg angles ($2\theta \pm 0.2$ degree) of 6.8°, 15.5°, 25.3°, 26.8°, 27.4°, 28.7°, 31.5° and 32.8°. The conversion to induced alpha-type charge generation material can be detected by an X-ray diffraction analyzer. The mill used herein for the present invention may be, for example, ball mill, sand mill, attritor, roll mill or micronizing mill and is preferably a ball mill with stainless steel milling beads.

The polymer binders which may be used as a binder for the charge generation materials as hereinbefore described include polyester, polyvinly butyral, polycarbonates, polyamides, cellulose acetate butyrate, phenolic resin and phenoxy resin.

The charge generation layer of the photoreceptor of the present invention is prepared by mixing in a suitable ratio the charge generation material prepared as hereinbefore described and the polymer binder by a dispersion mill, coating the resultant mixture on a conductive support, and then drying the coating by hot air in an oven. The weight ratio of the charge generation material and the polymer binder is preferably from 3:1 to 1:3. The dry thickness of the charge generation layer is preferably from 0.1 to 1.0 $g/m^{b\,2}$. The suitable dispersion mills include, for example, micronizing mill, ball mill and sand mill. Suitable methods for coating the charge generation layer include, for example, blade coating, spray coating, dip coating and Meyer-Bar coating.

To produce a photoreceptor, the conductive support coated with the described charge generation layer must be further coated with a charge transport layer. The charge transport layers are produced by solubilizing charge transport materials in another polymer binder, coating the resultant mixture on the charge generation layer, and drying the coating. Commonly used charge transport materials include, for example, hydrazone compounds such as p-diethylaminobenzaldehyde-N,N-diphenyl hydrazone, p-diethylamino-benzaldehyde-N-alpha-naphthyl-N-phenyl hydrazone, pyrazoline compounds such as 1-phenyl-3-(p-diethylaminostyryl)-5-(p-diethylaminophenyl) pyrazolines, and triaryl methanes such as bis(4-diethylamino-2-methylphenyl)-phenylmethane. The polymer binders suitable for use in combination with the charge transport material include, for example, polystyrene, styrene-acrylonitrile copolymer, acrylic resin, styrene-MMA copolymer, polyester, polycarbonate, epoxy resin, phenolic resin and phenoxy resin. Suitable methods for coating the charge transport layer include, for example, blade coating, spray coating, dip coating, Meyer-Bar coating and curtain coating.

The weight ratio of the charge transport material and the polymer binder in association thereof is preferably from 3:1 to 1:3. The dry thickness of the charge transport layer is preferably from 10 to 30 μm.

In a further preferred embodiment, a barrier layer may be introduced between the conductive support and the charge generation layer to prevent the reverse injection of electrons from the conductive support into the charge generation layer. Materials suitable for use as such barrier layer are, for example, polyamides, polyvinly alcohol, casein, nitro cellulose and methyl cellulose. The thickness of the adhesive layer is generally from 0.1 to 3.0 μm.

As hereinbefore described, the present invention provides a convenient and low cost process to produce a photoreceptor of high sensitivity, low dark conductance and high charge acceptance. The combination of two charge generation materials which in the past had difficulties in being put into practice unexpectedly provides excellent photoconductive properties which could not be realized alone by any of the ingredients thereof. The results are rarely seen in the field of organic photoconductive materials.

The photoreceptor of the present invention finds its broad application in, for example, copier, laser printer, facsimile machine and other optical printers utilizing electrophotography techniques.

Figure 2:
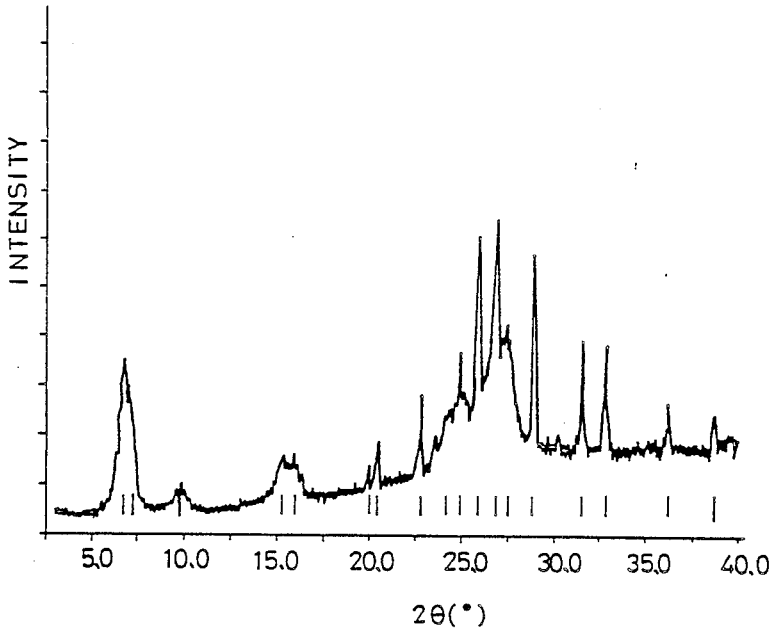
FIG. 2 is the X-ray diffraction diagram of the conventional alpha-type copper phthalocyanine.

Without exhibiting any intent to be bound by any theory of operation, it can be suggested that the charge generation material of the present invention functions in the following manner. FIG. 1 is the X-diffraction diagram of the "induced alpha-type" charge generation material of the present invention. FIG. 2 is the X-ray diffraction diagram of the conventional alpha-type copper phthalocyanine. As shown by a comparison between these two diagrams, the diffraction angle (2θ) position of the primary peak of the induced alpha-type charge generation material of the present invention is very similar to that of alpha-type copper phthalocyanine. But the crystalline structure is more loosened. The phenomenon is probably caused by the infiltration of squarylium into the crystalline structure of copper phthalocyanine which hinders the compact arrangement of the crystalline structure during the transformation of the crystalline structure of copper phthalocyanine in the mechanical milling operation. The resultant crystalline structure is believed to be the primary reason for the improvement of the present invention in dark insulation, charge acceptance and sensitivity. Furthermore, such crystalline structure can provide superior dispersibility which is desirable for processing.

The following examples are offered to aid in understanding of the present invention and are not to be construed as limiting the scope thereof. Unless otherwise indicated, all parts and percentages are by weight.

EXAMPLES

Preparation of charge generation materials 50 grams of a copper phthalocyanine and a squarylium compound of the species and amounts listed in Table I was milled in a ball mill using stainless steel beads as the milling beads for 48 hours.

TABLE I

Induced alpha-type charge generation materials of the Examples

Squarylium

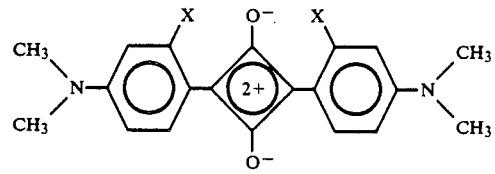

| Material No. | Copper phthalocyanine | Squarylium weight (g) | Squarylium X |
|---|---|---|---|
| (1) | epsilon-type (Heleigen Blue L6700 from BASF) | 5.0 | OH |
| (2) | epsilon-type (Heleigen Blue L6700 from BASF) | 6.25 | OH |
| (3) | epsilon-type (Heleigen Blue L6700 from BASF) | 10.0 | OH |
| (4) | epsilon-type (Heleigen Blue L6700 from BASF) | 2.5 | OH |
| (5) | epsilon-type (Heleigen Blue L6700 from BASF) | 2.5 | H |
| (6) | alpha-type (Heleigen Blue 6900 from BASF) | 5 | OH |

EXAMPLE 1

Preparation of a photoreceptor of the present invention

Preparation of a barrier coating layer on a conductive support

The barrier layer of the composition listed in Table II was coated on an aluminium plate of 0.2 mm thickness by a dip coating procedure and then dried in a hot air of 80° C. in an oven, resulting in an barrier layer of 1.0 g/m² thickness on the aluminium support.

TABLE II

Composition of barrier layer

| Ingredient | weight (grams) |
|---|---|
| Polyamide copolymer (CM 8000 from Toray, Japan) | 10 |
| Methanol | 60 |
| n-Butanol | 40 |

Preparation of charge generation coating layer on the support

The charge generating materials, polymer binder and solvents of Table III were mixed and dispersed by a sand mill for about 20 hours. The resultant mixture was then coated on the barrier layer and then dried by hot air of 80° C. in an oven for about 30 minutes, resulting in a charge generation layer of about 0.3 g/m² thickness.

TABLE III

Ingredients for charge generation layer

| Ingredients | weight (grams) |
|---|---|
| Charge generation Material (1) | 10 |
| Polyvinyl butyral (BM-2 from Sekisui Chemical, Japan) | 10 |
| cyclohexanone | 225 |
| butanone | 450 |

Preparation of charge transport coating layer on the charge generation layer

A mixture of 10 grams of the charge transport material of the formula

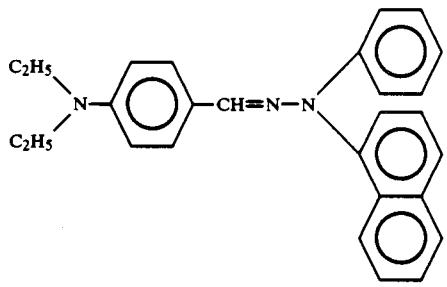

15 grams of styrene-methyl methacrylate copolymer binder (MS200 from Seitetsu Chemical, Japan), and 80 grams of toluene was coated by Meyer-Bar method on the charge generation layer and dried in hot air of 100° C. in an oven for 60 minutes, resulting in a charge transport layer of about 20μm thickness.

The resultant organic photoreceptor was tested by Electrostatic Paper Analyzer Model EPA-8100 manufactured by Kawaguchi Electric, Japan to determine its photoconductivity. The corona charge was set at −5.0 kV and the corona charge speed was set at 5 m/min. The initial surface potential on the sample was recorded as $V^0$. After 10 seconds of dark decay, the surface potential was recorded as $V_{10}$. We define dark decay rate (DDR) as $(V_0V_{10})/V_0$. The sample was then exposed under a tungsten light source of 5 Lux intensity and the surface potential began to attenuate. The light energy consumed until the surface potential dropped to a half of $V_{10}$ (half decay exposure) was calculated and recorded as $E_{178}$ (in Lux.sec). The same procedures and conditions were followed but the light source was replaced by a light source of 780 nm wavelength. The light energy consumed until the surface potential dropped to a half of $V_{10}$ was calculated and recorded as $E_{\frac{1}{2}}^{780}$ (in $\mu J/cm^2$). The results were listed in Table IV along with other data from the following examples.

EXAMPLE 2

The procedures and condition of Example 1 were followed, but the induced alpha-type charge generation material (2) was used instead of material (1). The results were listed in Table IV.

EXAMPLE 3

The procedures and condition of Example 1 were followed, but the induced alpha-type charge generation material (3) was used instead of material (1). The results were listed in Table IV.

EXAMPLE 4

The procedures and condition of Example 1 were followed, but the induced alpha-type charge generation material (4) was used instead of material (1). The results were listed in Table IV.

EXAMPLE 5

The procedures and condition of Example 1 were followed, but the induced alpha-type charge generation material (5) was used instead of material (1). The results were listed in Table IV.

EXAMPLE 6

The procedures and condition of Example 1 were followed, but the induced alpha-type charge generation material (6) was used instead of material (1). The results were listed in Table IV.

COMPARATIVE EXAMPLE A

The procedures and condition of Example 1 were followed, but the epsilon-type copper phthalocyanine was used instead of induced alpha-type charge generation material (1). The results were listed in Table IV.

COMPARATIVE EXAMPLE B

The procedures and condition of Example 1 were followed, but the alpha-type copper phthalocyanine was used instead of induced alpha-type charge generation material (1). The results were listed in Table IV.

COMPARATIVE EXAMPLE C

The procedures and condition of Example 1 were followed, but hydroxy squarylium was used instead of induced alpha-type charge generation material (1). The results were listed in Table IV.

COMPARATIVE EXAMPLE D

The procedures and condition of Example 1 were followed, but a mixture of epsilon-type copper phthalocyanine and hydroxy squarylium in the weight ratio of 10:1 was used instead of induced alpha-type charge generation material (1). The results were listed in Table IV.

COMPARATIVE EXAMPLE E

The procedures and condition of Example 1 were followed, but a mixture of alpha-type copper phthalocyanine and hydroxy squarylium in the weight ratio of 10:1 was used instead of induced alpha type charge generation material (1). The results were listed in Table IV.

EXAMPLE 7

The procedures and condition of Example 1 were followed, but the charge transport material was replaced by the charge transport material of the formula

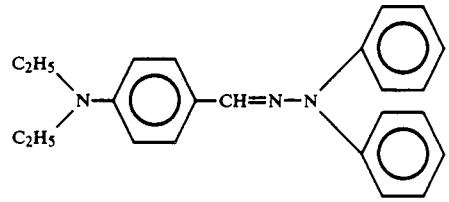

The results were listed in Table IV.

EXAMPLE 8

The procedures and condition of Example 1 were followed, but the charge transport material was replaced by a pyrroline series charge transport material of the formula

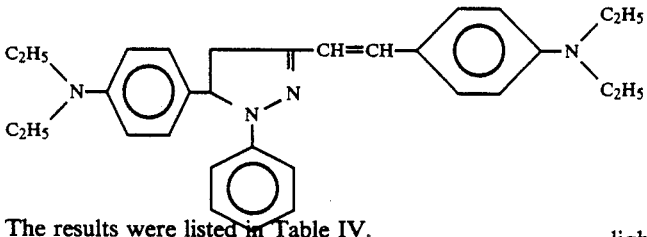

The results were listed in Table IV.

EXAMPLE 9

The procedures and condition of Example 1 were followed, but the charge transport material was replaced by the charge transport material of the formula

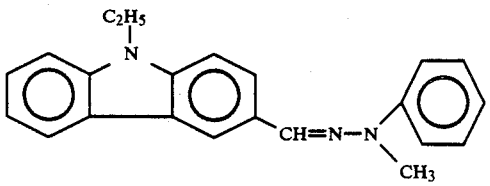

The results were listed in Table IV.

EXAMPLE 10

The procedures and condition of Example 1 were followed, but the charge transport material was replaced by a triaryl methane series charge transport material of the formula

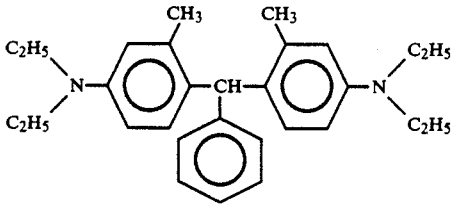

The results were listed in Table IV.

TABLE IV

| Example No. | $V_0$ (volt) | DDR (%) | $E_{\frac{1}{2}}$ Lux.sec | $E_{\frac{1}{2}}^{780}$ $\mu J/cm^2$ |
|---|---|---|---|---|
| 1 | 1070 | 18 | 1.5 | 0.6 |
| 2 | 1030 | 13 | 1.5 | 0.6 |
| 3 | 1080 | 19 | 2.0 | 0.6 |
| 4 | 1070 | 18 | 4.5 | 1.5 |
| 5 | 870 | 23 | 4.5 | 2.4 |
| 6 | 825 | 30 | 1.5 | 0.5 |
| A | 1080 | 18 | 12 | 4.8 |
| B | 260 | 77 | * | * |
| C | 170 | 58 | * | * |
| D | 470 | 79 | * | * |
| E | 200 | 80 | * | * |
| 7 | 960 | 19 | 2.0 | 0.7 |
| 8 | 1000 | 24 | 1.5 | 0.5 |
| 9 | 970 | 21 | 3.1 | 1.0 |
| 10 | 1100 | 13 | 1.5 | 0.5 |

*too low to be detected due to sever dark decay

As shown by the results of Examples 1-10 as compared with those of Comparative Example A-E, the photoreceptors according to the present invention which employ copper phthalocyanine pigments directly available from the market and squaryliums which can be conveniently synthesized by an acid route, not only possess high charge acceptance and low dark conductance, but also exhibit high sensitivity to both visible light and near infrared light. Two conventionally ineffective charge generation materials can be combined to form an unexpectedly excellent charge generation material for photoreceptors.

While only limited embodiments of the present invention have been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

I claim:

1. A photoreceptor comprising a conductive support, a charge generation layer coated on said conductive support and a charge transport layer coated on said charge generation layer wherein said charge generation layer comprises a polymer binder and an induced alpha-type charge generation material prepared by milling a mixture of copper phthalocyanine pigment and a squarylium pigment in a weight ratio between 100:3 and 100:30.

2. The photoreceptor according to claim 1, in which the relative ratio of said copper phthalocyanine pigment to said squarylium pigment is from 100:5 to 100:20.

3. The photoreceptor according to claim 1, in which said copper phthalocyanine pigment is of alpha-type crystalline structure or epsilon-type crystalline structure.

4. The photoreceptor according to claim 1, in which said squarylium is selected from the compounds of the formula (I)

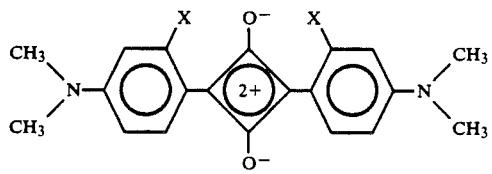

(I)

wherein X is hydroxy, hydrogen or $C_{1-5}$ alkyl.

5. The photoreceptor according to claim 4, in which X is hydroxy, hydrogen or methyl.

6. The photoreceptor of claim 1, in which said polymer binder is selected from the group consisting of polyester, polyvinylbutyral, polycarbonates, polyamides, cellulose acetate butyrate, phenolic resin and phenoxy resin.

7. The photoreceptor according to claim 1, in which the weight ratio of said charge generation material to said polymer binder is between 1:3 and 3:1.

8. The photoreceptor according to claim 1, in which the mill adopted for said milling is selected from ball mill, sand mill, attritor, roll mill or micronizing mill.

9. The photoreceptor according to claim 8, in which said miller is a ball mill with stainless milling beads.

* * * * *

UNITED STATES PATENT AND TRADEMARK OFFICE

CERTIFICATE OF CORRECTION

PATENT NO. : 4,983,483

DATED : January 8, 1991

INVENTOR(S) : Lii-Chyuan Tsai

It is certified that error appears in the above-identified patent and that said Letters Patent is hereby corrected as shown below:

Column 2, line 32: "delta-pi," should read as --delta-, pi,--

Column 3, line 3: insert "DETAILED DESCRIPTION OF THE INVENTION"

Column 4, line 42: "$g/m^{b2}$." should read as --$g/m^2$.--

Column 7, line 34: "$(V_0V_{10})/V_0$." should read as --$(V_0-V_{10})/V_0$.--

Column 7, line 39: "$E_{178}$" should read as --$E_{1/2}$--

Column 8, line 42: "alpha type" should read as --alpha-type--

Signed and Sealed this

Twenty-first Day of July, 1992

*Attest:*

DOUGLAS B. COMER

*Attesting Officer*

*Acting Commissioner of Patents and Trademarks*